US007770340B2

(12) United States Patent
Heady et al.

(10) Patent No.: US 7,770,340 B2
(45) Date of Patent: Aug. 10, 2010

(54) METHOD AND APPARATUS FOR INSTALLING EGRESS WINDOW STEPS

(76) Inventors: Timothy P. Heady, 505 NW. Chapel Dr., Ankeny, IA (US) 50021; Charles W. Heady, 928 Blue St., Norwalk, IA (US) 50212

( * ) Notice: Subject to any disclaimer, the term of this patent is extended or adjusted under 35 U.S.C. 154(b) by 1144 days.

(21) Appl. No.: 11/256,725

(22) Filed: Oct. 24, 2005

(65) Prior Publication Data

US 2007/0089373 A1 Apr. 26, 2007

(51) Int. Cl.
*E04F 17/06* (2006.01)
*A63H 33/08* (2006.01)

(52) U.S. Cl. ..... 52/107; 52/184; 52/169.6; 446/125

(58) Field of Classification Search ..... 52/107, 52/169.7, 289, 702, 589.1, 284, 574, 238.1, 52/184, 102; 446/120, 124, 125; 272/682; 4/506; 47/33
See application file for complete search history.

(56) References Cited

U.S. PATENT DOCUMENTS

| | | | | | |
|---|---|---|---|---|---|
| 300,654 | A | | 6/1884 | Smith | |
| 1,057,336 | A | * | 3/1913 | Feldhamer | 52/102 |
| 1,170,305 | A | * | 2/1916 | Marshall | 52/32 |
| 1,332,452 | A | * | 3/1920 | Wilbur | 182/57 |
| 2,678,629 | A | * | 5/1954 | Meyer | 119/514 |
| 2,691,242 | A | * | 10/1954 | Young | 446/115 |
| 3,343,301 | A | * | 9/1967 | Philip | 47/33 |
| 3,410,441 | A | * | 11/1968 | Rhyne | 220/4.28 |
| 3,591,212 | A | * | 7/1971 | Rhyne | 217/65 |
| 3,672,739 | A | * | 6/1972 | Taut | 312/107 |
| 3,692,201 | A | * | 9/1972 | Garduna | 217/12 R |
| 3,780,469 | A | * | 12/1973 | Hancovsky | 446/127 |
| 3,831,934 | A | * | 8/1974 | Hancovsky | 472/114 |
| 3,836,217 | A | * | 9/1974 | Seiichi | 312/107 |
| 3,999,334 | A | | 12/1976 | Webb | |
| 4,173,287 | A | * | 11/1979 | Kumakawa | 217/65 |
| 4,681,302 | A | * | 7/1987 | Thompson | 256/13.1 |
| 4,782,972 | A | * | 11/1988 | Wenkman et al. | 220/4.28 |
| 4,869,018 | A | * | 9/1989 | Scales et al. | 47/33 |
| 4,876,833 | A | | 10/1989 | Gefroh et al. | |
| 4,880,210 | A | * | 11/1989 | Cucksey | 256/26 |
| 4,893,445 | A | * | 1/1990 | Hefer et al. | 52/234 |
| 4,982,535 | A | * | 1/1991 | Pickett | 52/71 |
| 5,046,789 | A | * | 9/1991 | Lee | 312/108 |
| 5,080,523 | A | * | 1/1992 | Steiner | 404/7 |
| 5,107,640 | A | * | 4/1992 | Gefroh et al. | 52/107 |
| 5,168,678 | A | * | 12/1992 | Scott et al. | 52/102 |
| 5,210,984 | A | * | 5/1993 | Eckel | 52/79.5 |

(Continued)

FOREIGN PATENT DOCUMENTS

WO WO 2004074593 A1 * 9/2004

*Primary Examiner*—Robert J Canfield
*Assistant Examiner*—Babajide Demuren
(74) *Attorney, Agent, or Firm*—McKee, Voorhees & Sease, P.L.C.

(57) ABSTRACT

A modular egress window well structure which is constructed of structurally identical walls that interlock and attach to the foundation of a building via a termination strip. The identical wall members allow for ease of manufacturing and installation of the egress window well. The method of installation comprises removing soil away from the foundation of a building, securing the termination of strips to the foundation, assembling the egress window well and then backfilling the soil around the structure.

15 Claims, 7 Drawing Sheets

U.S. PATENT DOCUMENTS 5,215,490 A * 6/1993 Szoradi ..... 446/115
5,273,477 A * 12/1993 Adams, Jr. ..... 446/108
5,357,728 A * 10/1994 Duncanson ..... 52/592.4
5,640,816 A * 6/1997 Reiland et al. ..... 52/239
5,657,587 A * 8/1997 Gefroh ..... 52/107
5,746,038 A * 5/1998 Houk ..... 52/590.1
5,901,526 A * 5/1999 Vidmar et al. ..... 52/745.09
6,105,654 A * 8/2000 Martel ..... 160/135
6,174,116 B1 * 1/2001 Brand ..... 410/140
6,189,271 B1 * 2/2001 Christensen ..... 52/233
6,418,675 B1 * 7/2002 Peggs et al. ..... 52/102
6,453,973 B1 * 9/2002 Russo ..... 160/135
6,484,455 B1 * 11/2002 Poole ..... 52/107
6,713,009 B2 3/2004 Van Gilst
6,880,300 B2 4/2005 Hawkes
2003/0230026 A1 * 12/2003 Dillon ..... 47/33
2004/0074189 A1 * 4/2004 Deschenes ..... 52/589.1

* cited by examiner

METHOD AND APPARATUS FOR INSTALLING EGRESS WINDOW STEPS

BACKGROUND OF THE INVENTION

This invention relates to a modular window well egress and a method of installing the same. More specifically, though not exclusively, the invention relates to a modular egress window well with modular walls that are structurally identical and providing a simple means of installing a window well egress below ground level that is also easy to manufacture.

As land prices have increased, homeowners have looked for means of better utilizing a building's footprint. To do so, building owners have turned to using basement or below grade level space as living space. This raises several issues, such as being able to quickly exit the building in case of an emergency. To allow egress from the basement, building designers have incorporated means of exiting through a basement window into window well designs. These designs have included window well walls with built in steps, hand grips, and other devices that facilitate exiting through the basement window.

Many different designs have been used to create basement window wells. Early designs incorporated window wells into foundations of the building or home. The well was lined with bricks and then capped with additional bricks, wood or iron plating. This was done in an attempt to retain soil and increase the amount of light that entered into the below ground living space. The window was also used to allow the passage of materials, typically coal, into the basement without having to carry the material through the house. These early designs had to be incorporated at the beginning of construction and were nearly impossible to install after the building was formed.

The next step in the design evolution was to create a structure that could be manufactured separately from the foundation of the building. Still in use today, this design typically involves using corrugated and galvanized sheets of metal bent into a generally U-shaped structure that was then attached to the exterior of a building's foundation. The galvanized metal resisted the elements better than previous materials and was easily manufactured. Unfortunately, the galvanized material is unsightly and unattractive to an individual looking out the window. Further, the unitary design increases the difficulty of handling and installing the galvanized metal well structure.

For relatively shallow window wells, there was no need for the window well to incorporate devices or structures that would assist an individual in exiting through a basement window. But with increased building code regulations, the size of a basement window has increased to facilitate egress from within the basement. With this increase in window size, came the requirement for window wells to become deeper. With a deeper window well, there is a need for a structure within the well itself to facilitate exiting the window well. The first solution was the incorporation of a ladder structure outside of the confines of the window well that had to be lowered in. Later designs incorporated recesses and protrusions in the surface of the window well itself. Because the wells were typically constructed of galvanized corrugated sheet metal, the steps and handles were difficult to form and slippery when wet.

U.S. Pat. No. 3,999,334 to Webb discloses a basement escape window structure with a one-piece unit that has a hinged top that serves as an escape hatch from the basement. It also discloses a device with a plurality of steps that allow for easily ascending from the basement in order to escape from an opening in a basement wall. Because of the unitary design, the system is difficult to install. Further because of the lid, the device does not allow sunlight into the basement and completely obstructs the view that might have been afforded with the use of a more traditional window well.

The most recent development in egress window well design is a modular approach as demonstrated in U.S. Pat. Nos. 5,107,640 to 5,657,587 to Gefroh. Instead of the structure being constructed as a single unit, it is instead comprised of multiple parts and modules. The modular design allows for ease of construction, either during the original construction of the building or as a later addition. The modular concept also allows for the replacement of damaged and weathered parts without complete removal and disposal of the entire egress structure. The current designs are deficient in that they are comprised of multiple components of various sizes and shapes.

The variance in the modular pieces increases the cost of manufacturing a complete modular egress window well structure. Multiple tool sets are required to be used in the production of the individual walls. A greater number of individualized components cause a manufacturer's boxing and shipping system to be more complex to ensure that the correct components are shipped. The variance in shapes and size of the components also increase the number of shipping containers necessary to transport the entire system to the final destination. Further, because of the variety of necessary components, a retailer must stock many more components than is necessary to meet on demand needs.

Therefore, there is a need for an improved egress window well structure that consists of a limited number of components that can be easily manufactured. This structure should consist of components that are sightly yet constructed of material that are durable to environmental elements.

FEATURES OF THE INVENTION

A general feature of the present invention is the simplification of the construction of a below ground modular window well egress.

A further feature of the present invention is the provision of a modular window well egress with walls that are structurally identical.

An additional feature of the present invention is the provision of window well egress walls that interlock with one another.

Yet another feature of the present invention is the provision of a wall termination strip that interlocks with a window well egress wall.

Another general feature of the present invention is the provision of a rigid step that is placed between two non-parallel window well egress walls.

Still another feature of the present invention is the ability to stack the window well egress walls one on top of another to vary the depth below ground of the window well.

Still yet another feature of the present invention is the provision of a rigid wall for a modular egress window well structure that is easy to mass produce.

BRIEF SUMMARY OF THE INVENTION

The present invention generally comprises a method and apparatus for installing an egress window well. This structure consists of structurally identical walls that interlock via a system of protruding tenon and recessed notch. The pattern of protruding tenon and recessed notch could consist of any multiple number of tenon and notches such that one end pattern is the reciprocal of the other. Further, the walls are constructed of any material rigid enough to retain soil away from a below ground window. The space created allows the admittance of light and further allow the window to be used as an egress from the interior of a building. The walls are secured to the foundation of the building via interlocking termination strips.

DETAILED DESCRIPTION OF THE PREFERRED EMBODIMENT

The present invention will be described as it applies to its preferred embodiment. It is not intended that the present invention be limited to the described embodiment. It is intended that the invention cover all modifications and alternatives, which may be included within the spirit and scope of the invention. In a preferred embodiment, the modular egress window well is constructed as three identical planar structures that interlock and connect to a building foundation via termination strips.

Figure 1:
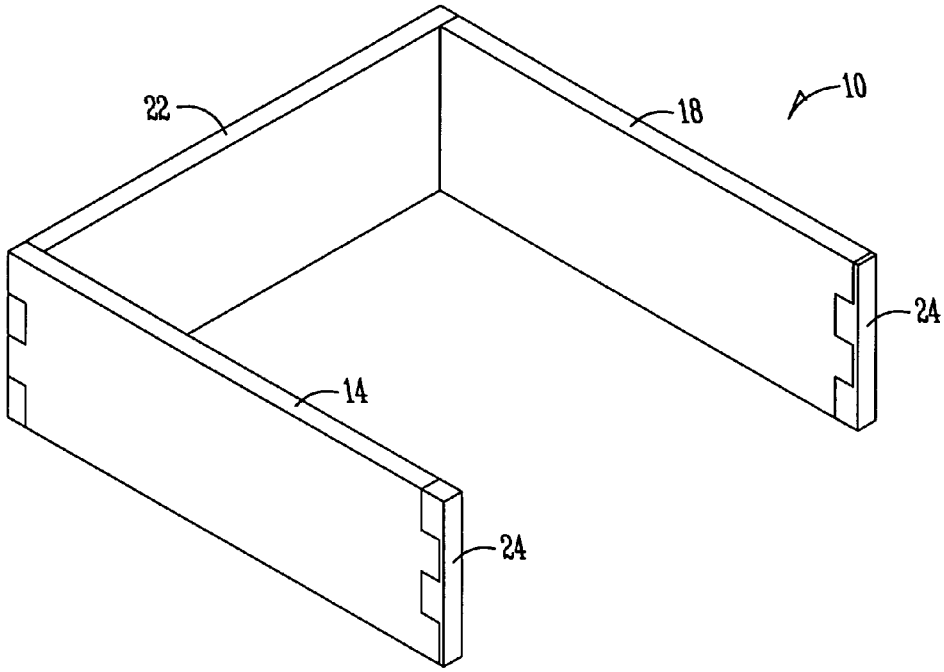
FIG. 1 is a perspective view of an embodiment of the invention.
Figure 2:
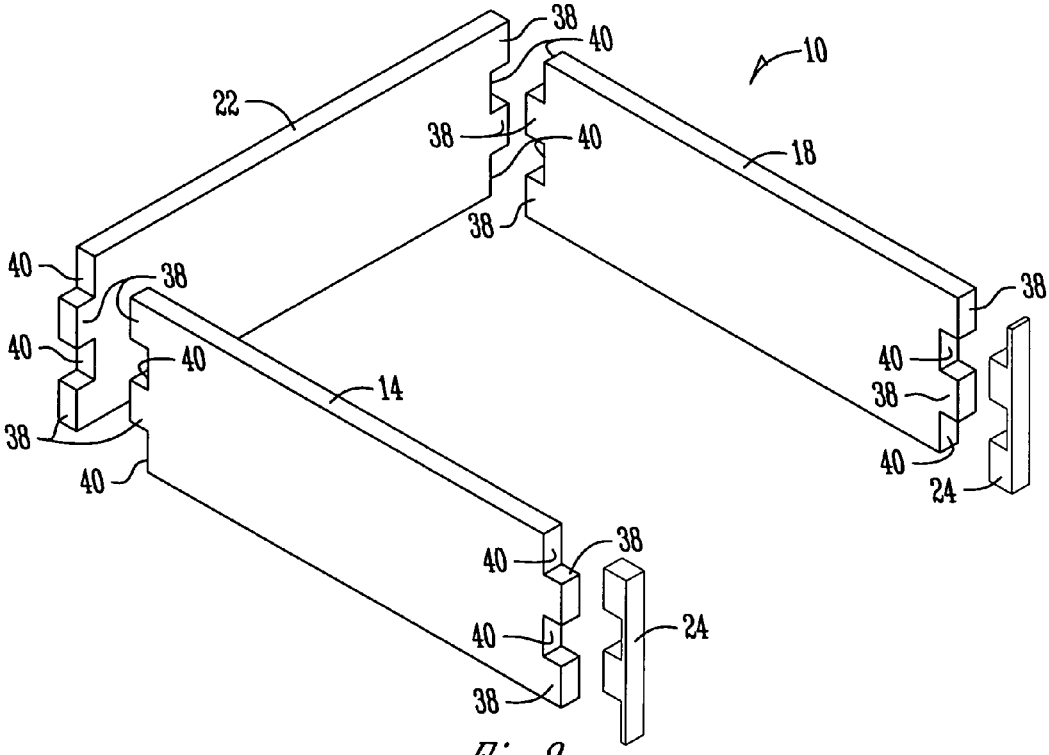
FIG. 2 is an exploded view of the embodiment shown in FIG. 1.

Now, referring to the drawings, FIG. 1 illustrates the preferred embodiment as a modular egress window well 10 having a first side wall 14, a second side wall 18, and a front wall 22. FIG. 1 illustrates the first side wall 14 and second side wall 18 attaching to termination strips 24. As shown in FIG. 2, the front wall 22 interlocks with the first side wall 14 and second side wall 18.

Figure 3:
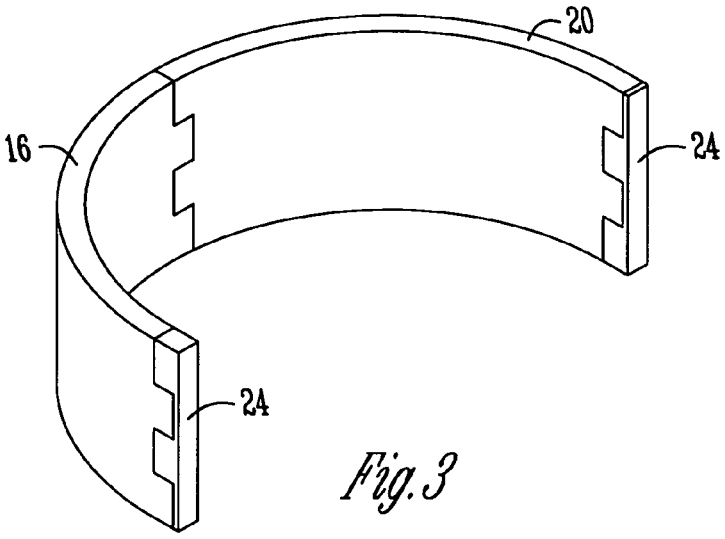
FIG. 3 is a perspective view of another embodiment of the invention.
Figure 4:
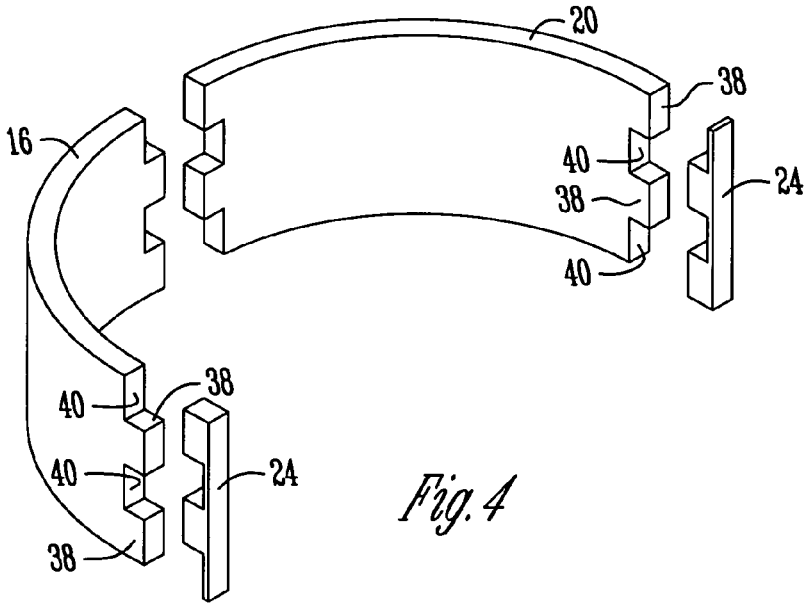
FIG. 4 is an exploded view of the embodiment shown in FIG. 3.

FIG. 3 illustrates another embodiment of a modular egress window well 10 having a first arcuate side wall 16 and a second arcuate side wall 20. FIG. 3 illustrates that two arcuate walls 16, 20 attaching to termination strips 24 that attach to the foundation of a building. Further, the arcuate side walls 16, 20 interlock to form a solid barrier to form a space about a below ground window. The two embodiments described disclose a planar and arcuate rectangular wall to form the necessary side walls to create an egress window well. Other shapes and sizes are contemplated, including shapes with an upper surface 26 and a lower surface 28 that is sinusoidal, scalloped, triangular, and/or of any other fanciful design that can have the reciprocal image formed along the opposite surface (see FIGS. 5, 5A, 5B).

Figure 5:
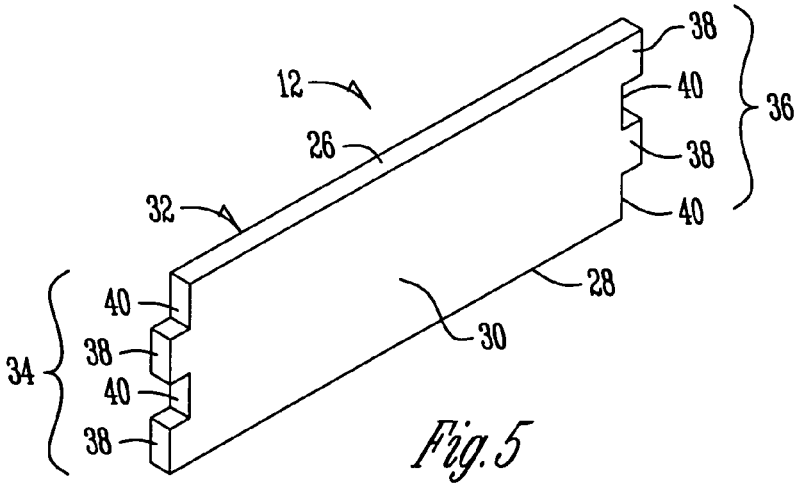
FIG. 5 is a perspective view of an embodiment of a modular wall section.
Figure 5A:
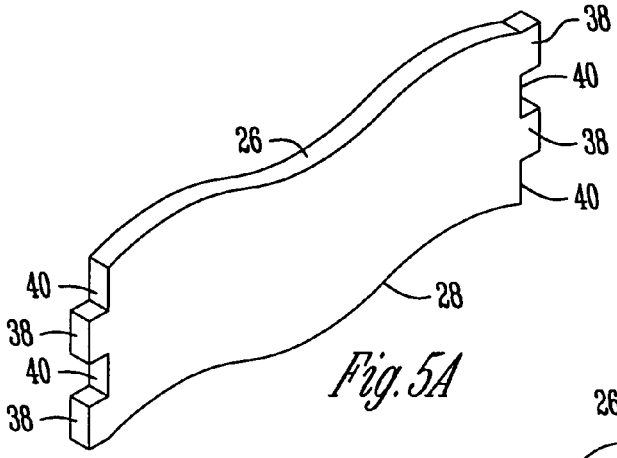
FIGS. 5A and 5B is a perspective view of another embodiment of a modular wall section.
Figure 5B:
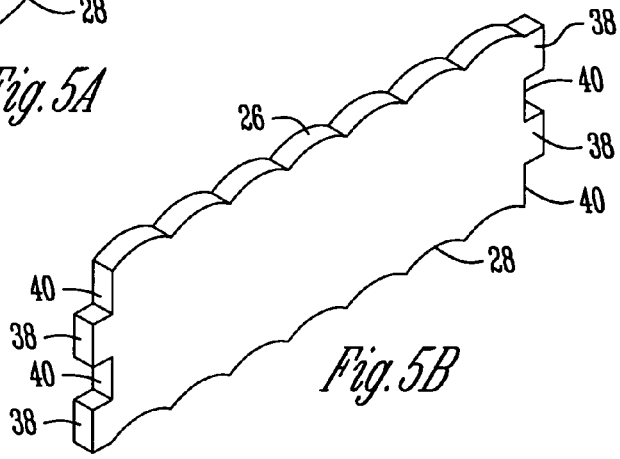

As shown in FIG. 5, the generic modular egress window well wall 12 has an interior surface 30, exterior surface 32, upper surface 26, and a lower surface 28. The wall 12 further has a first end 34 and second end 36 that consist of a pattern of tenon 38 and notch 40. The first ends 34 pattern of tenon 38 and notch 40 is the reciprocal of the second ends 36 pattern of tenon 38 and notch 40. The pattern created by the tenon 38 and notch 40 can vary both by the number of each and the spacing between and still be effective so long as the two ends 34, 36 have a reciprocal pattern that facilitates the wall 12 interlocking with each other.

Figure 6:
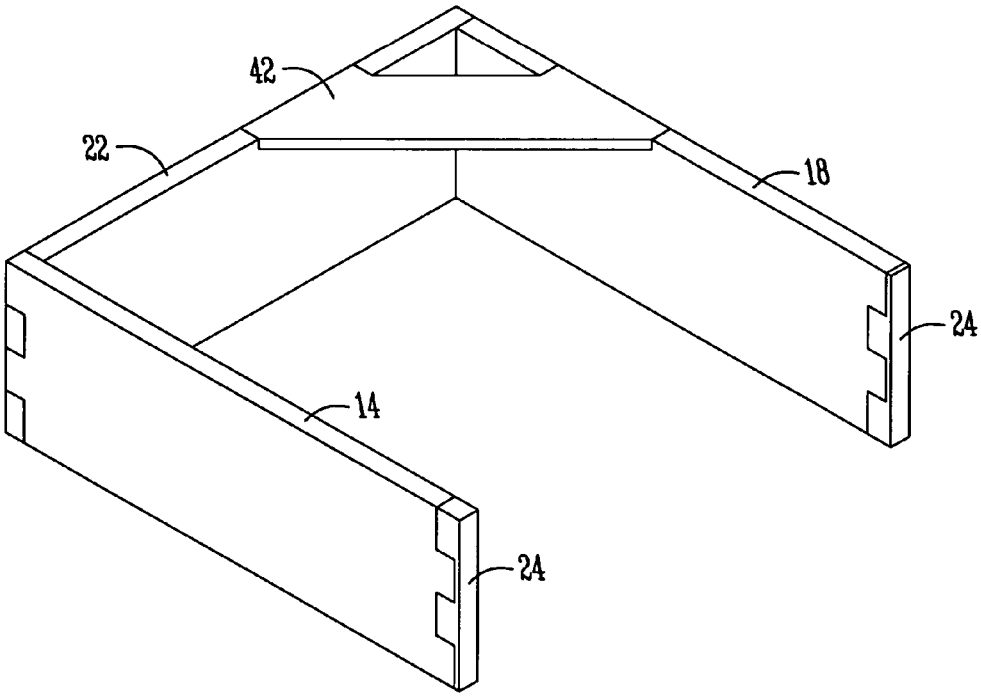
FIG. 6 is a perspective view of an embodiment of the invention including a rigid step.

A further feature is depicted in FIG. 6. A rigid step 42 is shown to be spanning two non-parallel walls 18, 22. The rigid step 42 rests upon the upper surface 26 and engages the interior 30 and exterior 32 surfaces of the two walls 18, 22. The rigid step 42 provides further rigidity to the egress window well 10 as well as provide a stepping surface for providing escape from deeper window wells.

Figure 7:
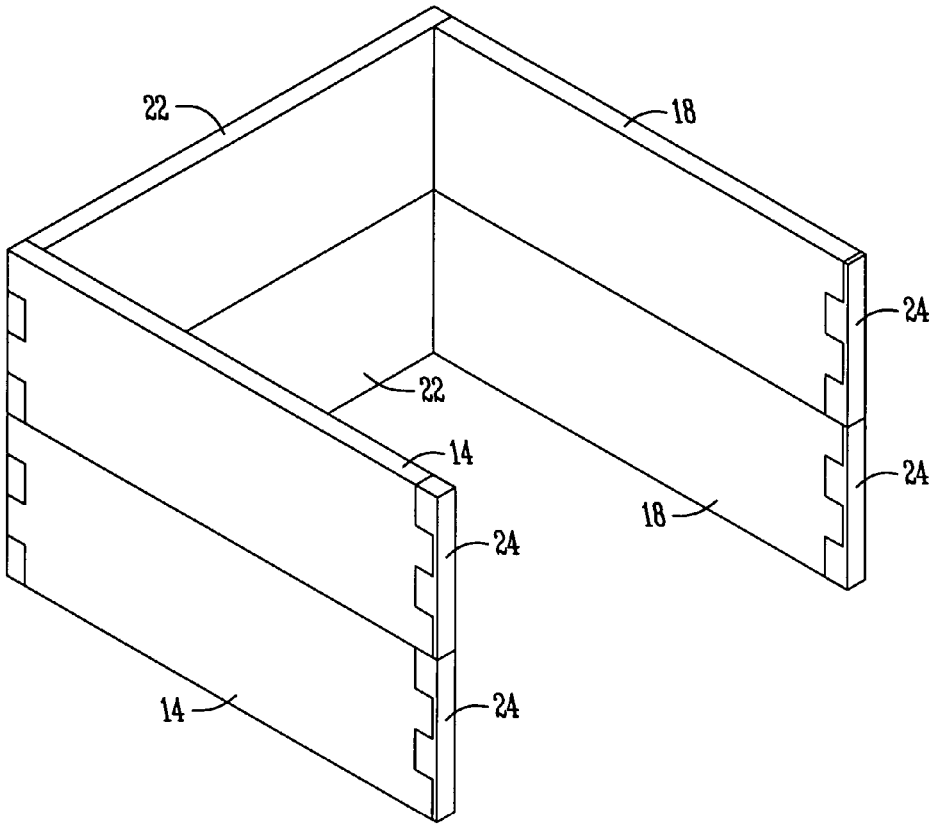
FIG. 7 is a perspective view of another embodiment of the invention comprising multiple layers of wall components.

To provide for deeper window wells, the modular walls 12 can be stacked on top of one another. FIG. 7 depicts multiple walls 12 stacked one on top of another to create a deeper well. Depending upon the design of the upper surface 26 and lower 28 surface, the stacked walls 12 may interlock vertically as well as horizontally.

Figure 8:
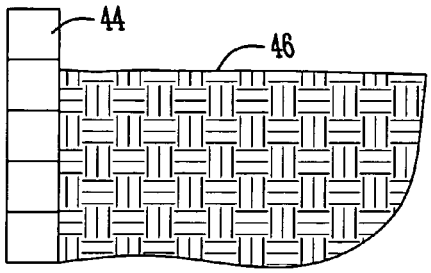
FIG. 8 is a cross-sectional view of a building foundation and the surrounding soil.
Figure 9:
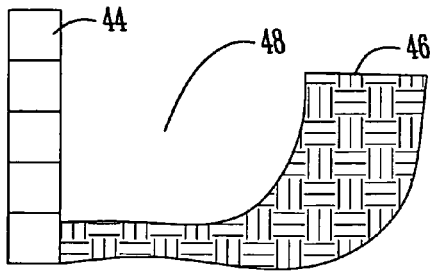
FIG. 9 is a cross-sectional view of a building foundation in a hole excavated adjacent to the foundation.

FIGS. 8-15 relate to a method of installing a modular egress window well. FIG. 8 depicts a cross-section of a building foundation 44 and the soil 46 that is adjacent to the foundation 44. FIG. 9 shows a hole 48 dug in the soil 46 adjacent to the foundation 44. FIG. 9 shows the preferred method of installation. Another method would be the installation of the modular egress window well 10 before soil 46 is placed against the foundation 44 and hence there would be no need of a hole 48. The size and dimension of the hole 48 is dependent upon the size of the window within the foundation 44 and the desired size of the window well.

Figure 10:
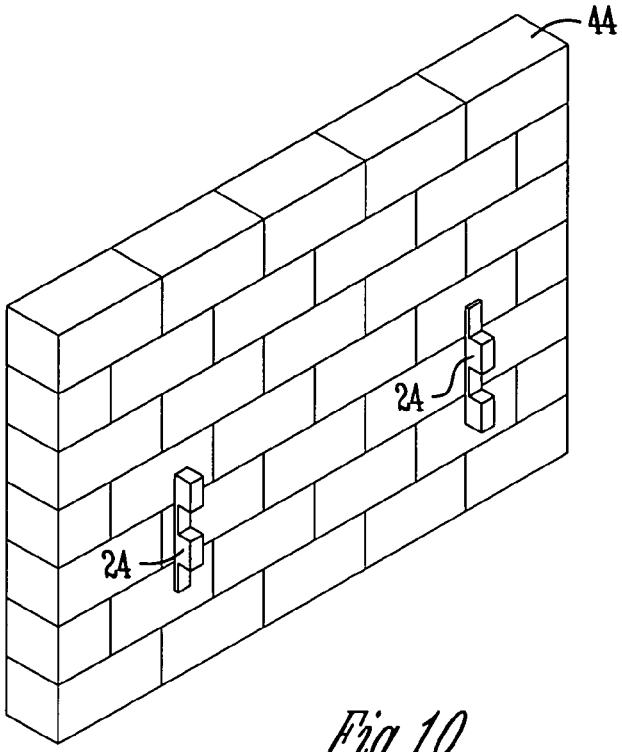
FIG. 10 is a perspective view of a section of the building foundation with a first and second interlocking strip mounted thereon.

FIG. 10 is a perspective view of a foundation 44. Two termination strips 24 are secured to the foundation 44 separated by a space. The first termination strip 24 is secured by glue, nails, screws or other suitable methods to foundation 44. The second termination strip 24 is also secured to the foundation 44 with the opposite orientation of the tenon 38 and notch 40 pattern. The two termination strips 24 are parallel to each other and are horizontally level with the bottom edge of each aligning with the other.

The termination strips 24 can be constructed of any material that provide sufficient rigidity to be formed into a tenon 38 and notch 40 pattern and secure the modular wall 12 to the foundation 44. Examples of material that could be used to form the termination strip 24 include aluminum and high density plastic.

FIG. 10 further depicts a foundation 44 without a window. The egress window well 10 can be installed before or after installation of a window into the foundation 44.

Figure 11:
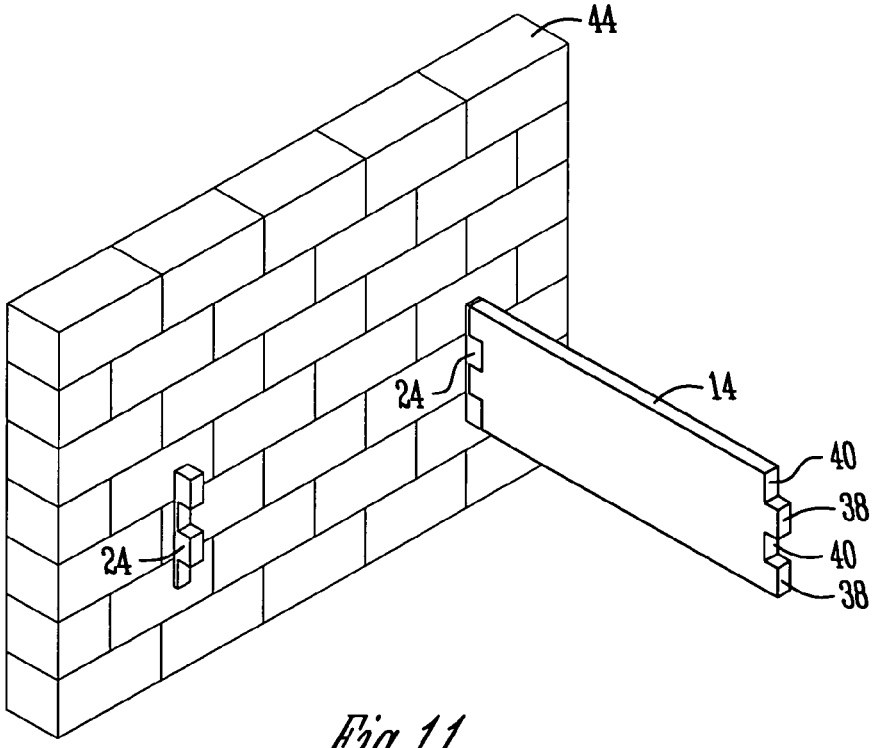
FIG. 11 is a perspective view of FIG. 10 with a first interlocking wall section joining with the first termination strip.

FIG. 11 shows the installation of the first side wall 14 onto the termination strip 24. The modular wall 12 is constructed of a material sufficiently rigid to retain soil 46 and to be formed with tenon 38 and notch 40. The walls 12 are constructed of high density plastic in the preferred embodiment but also may be made of high density polyethylene skin in a linear low density polyethylene core.

Figure 12:
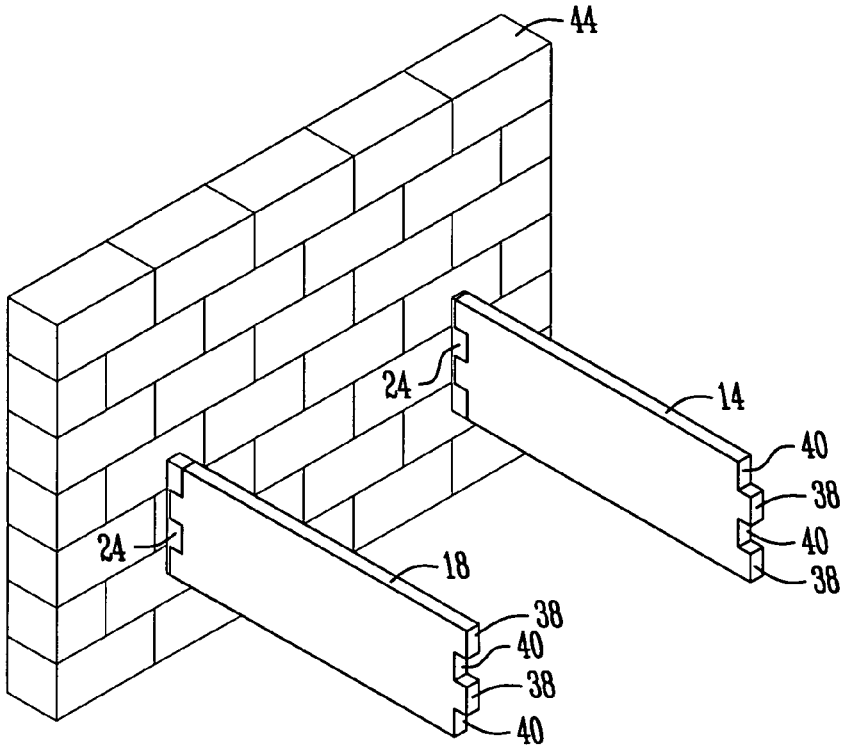
FIG. 12 is a perspective view of FIG. 11 with a second interlocking wall section joining with the second termination strip.
Figure 13:
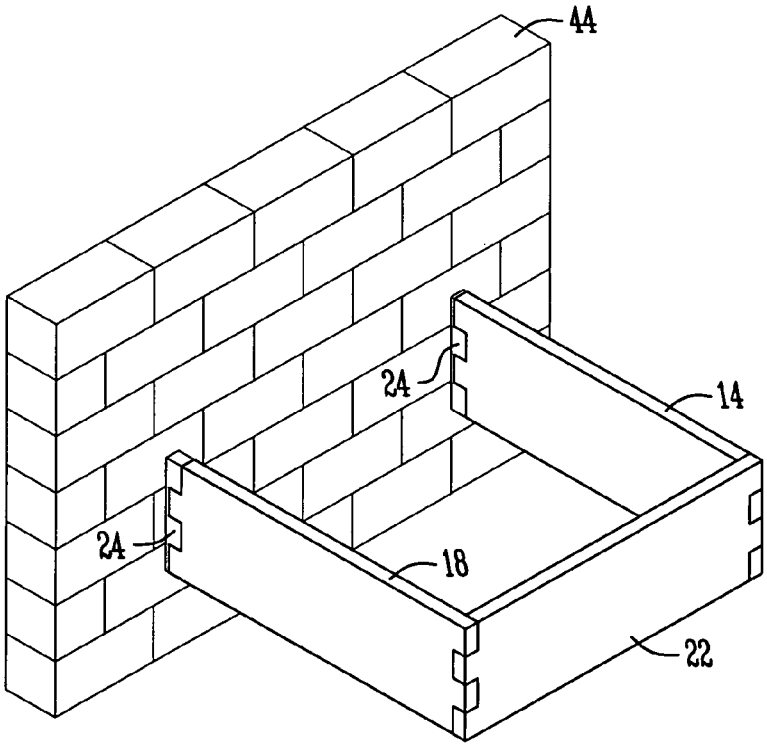
FIG. 13 is a perspective view of FIG. 12 with a third interlocking wall section interlocking with the first and second wall sections.
Figure 14:
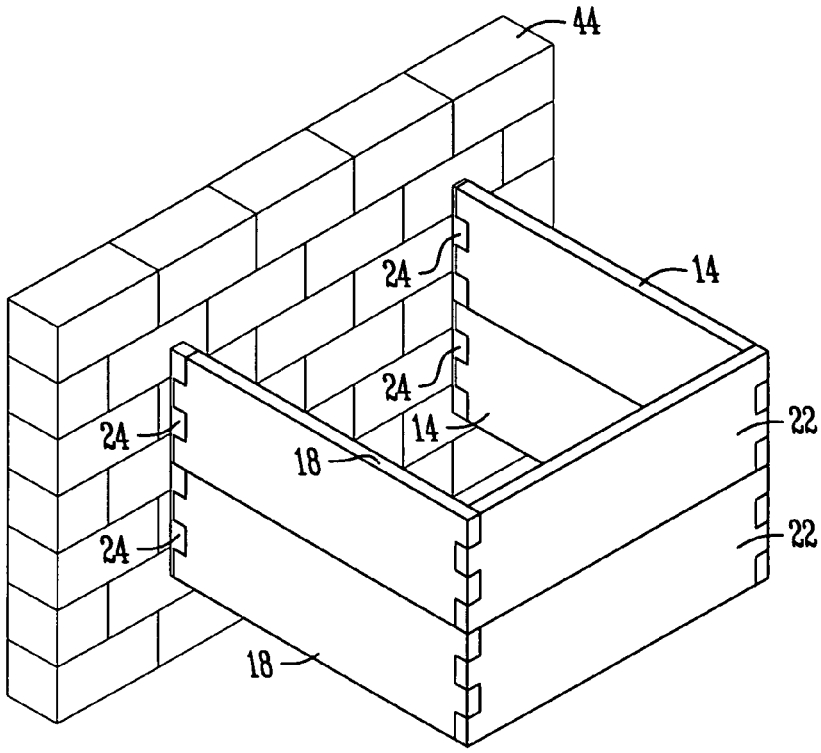
FIG. 14 is a perspective view of FIG. 13 with multiple layers of wall components.
Figure 15:
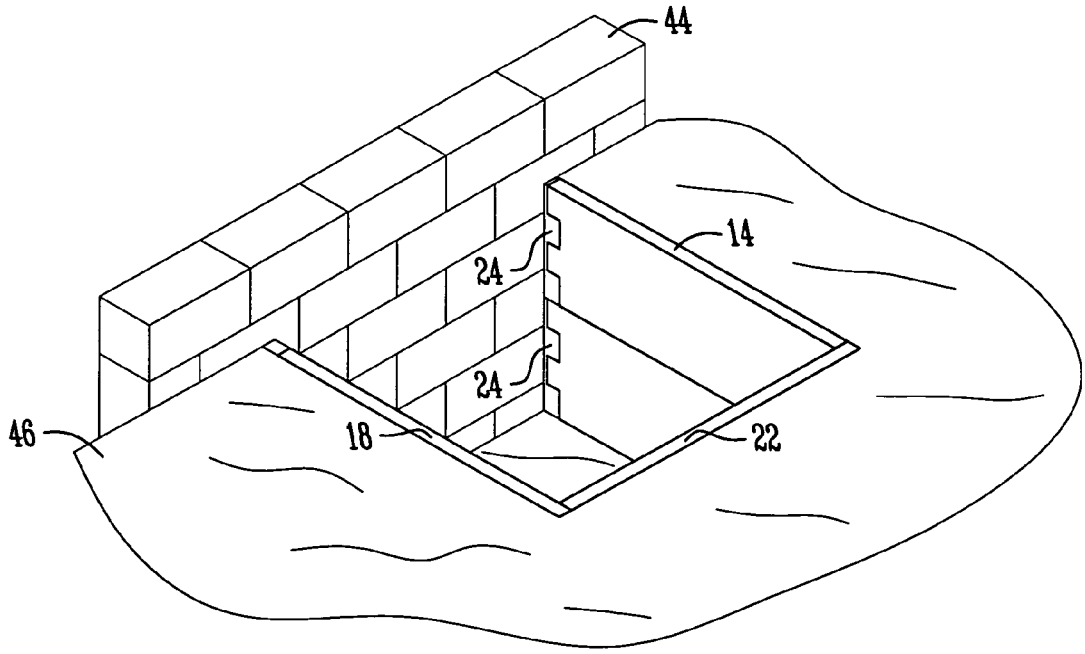
FIG. 15 is a perspective view of FIG. 14 with soil back filled around the egress window well.

FIG. 12 further illustrates the installation of an egress window well 10 with an insertion of a second side wall 18 into a termination strip 24. FIG. 13 shows a front wall 22 interlocking with the first side wall 14 and a second side wall 18. FIG. 14 shows a second layer of wall sections 12 having been stacked on top of the first layer of wall sections 12 and terminated unto additional termination strips 24. FIG. 15 depicts the egress window well 10 having been backfilled around, thus creating a space within the structure that can be used as an egress in conjunction with a window.

A general description of the present invention as well as a preferred embodiment to the present invention has been set forth. Those skilled in the art which the present invention pertains will recognize and be able to practice additional variations in the method and systems described which fall within the teachings of this invention. Accordingly, all such modifications and additions are deemed to be within the scope of the invention which is to be limited only by the claims appended hereto.

What is claimed is:

1. A modular egress window well structure comprising:

a first side wall;

a second side wall that is generally parallel to first side wall;

a front wall that directly interlocks with the side walls;

the first wall, second wall, and front wall each being structurally identical; and parallel wall termination strips secured to the wall of a building, wherein each of the wall termination strips directly interlocks with one of the first and second sidewalls.

2. The modular egress window well structure of claim 1 wherein a rigid step is placed between two nonparallel modular walls.

3. The modular egress window well structure of claim 1 wherein the walls are stackable.

4. The modular egress window well structure of claim 1 wherein each of the walls is planar.

5. The modular egress window well structure of claim 1 wherein the walls are comprised of a high density plastic material.

6. The modular egress window well structure of claim 1 wherein the walls are comprised of a high density polyethylene skin and a linear low density polyethylene core.

7. The modular egress window well structure of claim 1 wherein the walls are comprised of aluminum.

8. The modular egress window well structure of claim 2 wherein the step is comprised of a high density plastic material.

9. The modular egress window well structure of claim 2 wherein the step is comprised of a high density polyethylene skin and a linear low density polyethylene core.

10. The modular egress window well structure of claim 2 wherein the step is comprised of aluminum.

11. The modular egress window well structure of claim 1 wherein a plurality of steps bridge two nonparallel walls to define a plurality of steps in the interior of the egress window well.

12. The modular egress window of claim 1 wherein the wall termination strip consists of protruding tenon and recessed notch.

13. The modular egress window of claim 12 wherein an end of the wall termination strip consists of a protruding tenon and an opposite end consists of a recessed notch.

14. The modular egress window of claim 1 wherein the wall termination strip is comprised of a high density plastic material.

15. The modular egress window of claim 1 wherein the wall termination strip is comprised of aluminum.

* * * * *